US005444427A

United States Patent [19]

Ida et al.

[11] Patent Number: 5,444,427

[45] Date of Patent: Aug. 22, 1995

[54] IGNITION COIL DEVICE FOR ENGINE

[75] Inventors: Yasuhiko Ida; Makoto Sakamaki, both of Saitama, Japan

[73] Assignee: Toyo Denso Kabushiki Kaisha, Tokyo, Japan

[21] Appl. No.: 124,262

[22] Filed: Sep. 20, 1993

[30] Foreign Application Priority Data

Sep. 24, 1992 [JP] Japan ..... 4-305797
Sep. 24, 1992 [JP] Japan ..... 4-305798
Sep. 24, 1992 [JP] Japan ..... 4-305800

[51] Int. Cl.[6] ..... H01F 27/26

[52] U.S. Cl. ..... 336/198; 336/192; 336/178; 336/101; 336/96

[58] Field of Search ..... 339/90, 96, 105, 107, 339/178, 192, 198, 208, 234

[56] References Cited

U.S. PATENT DOCUMENTS 4,763,094 9/1988 Kojima .
4,926,152 5/1990 Ito et al. .
5,015,984 5/1991 Vialaneix .
5,032,814 7/1991 Badaud .
5,109,209 4/1992 Ida et al. .
5,257,611 11/1993 Chapekis et al. ..... 123/634

*Primary Examiner*—Leo P. Picard
*Assistant Examiner*—L. Thomas
*Attorney, Agent, or Firm*—Lyon & Lyon

[57] ABSTRACT

An engine igniting coil device comprising a coil case with a plurality of coil units disposed therein and integrally potted with insulating resin, which is featured by provision with a coil cover that fits in the coil case and can mount therein high-voltage and low-voltage terminal sockets for the coil units, allowing the assembly of the electrical connections of the coil units in optimal conditions.

6 Claims, 10 Drawing Sheets

IGNITION COIL DEVICE FOR ENGINE

BACKGROUND OF THE INVENTION

The present invention relates to an engine igniting coil device.

Recently, there has been developed such an engine igniting coil device which comprises one coil case wherein a plurality of coil units selected in accordance with the quantity of engine cylinders are arranged without using a distributor and integrally molded by potting with insulating material such as epoxy resin and the like.

In such an engine igniting coil device of prior art, a high-voltage leading-out terminal and a secondary coil terminal for each of the coil units mounted in the coil case are previously connected with each other by soldering or like method and then integrally attached to the coil case by resin molding.

However, in resin molding of the high-voltage terminals of the coil units in the coil case it may happen that the terminals are not secured to their specified positions or are fixed in an inclined state because of nonuniformity of connections of the high-voltage terminals to the secondary side of the coil units. This may lead to variations in the quality of the products.

The conventional type engine igniting coil device is provided at its coil case with a high-voltage terminal socket for connecting a high-voltage cable thereto and a low-voltage terminal socket for connecting a low-voltage cable thereto. Coil units are first mounted at specified places within the coil case and connected at their terminals with corresponding sockets, then they are potted in the case with molten resin. Therefore, the conventional device requires soldering wires of the coil units mounted in the coil case to corresponding terminal sockets. This means that wiring must be carried out with difficulty in a very narrow space between each coil unit and the coil case by means of soldering or a like method, and the space necessary for wiring serves as dead space thereby increasing the size of the coil case.

As shown in FIG. 18, the conventional type engine igniting coil device is constructed in such a way that each of coil units 2'A, 2'B and 2'C mountable in a coil case is provided at a flange of its secondary coil bobbin with a high-voltage terminal holder 18 integrally formed thereat and having a terminal receptacle. The electrical connection of each coil unit 2' is made by inserting a pin of a high-voltage terminal socket 4 into a receptacle of the high-voltage terminal holder 18 provided at the coil unit 2'. An attempt to decrease the dimension of the conventional type engine igniting coil device has been made by minimizing the distance P1 between coil units 2' in the coil case 1 assuring a possibly wide distance P2 between respective high-voltage terminal sockets 4 for coil units 2'. However, the attempt has encountered a problem that the distances P1 and P2 for each coil unit differ from each other, therefore the coil units must have their terminal holders 18 formed at different places according to different positions of high-voltage terminal pins 5 of corresponding high-voltage terminal sockets 4.

As shown in FIG. 18, the coil case 1 contains three coil units: a left unit 2'A with a terminal holder 18 shifted to the left, a center unit 2'B with a terminal holder 18 positioned at the center and a right unit 2'C with a terminal holder 18 shifted to the right. Therefore, a distance P1 between neighboring coil units 2' in the coil case differs from a distance P2 between high-voltage terminal sockets 4 of the neighboring coil units, that requires preparing a plurality of coil units 2' which are different from each other in the position of the high-voltage terminal holder 18 of the secondary coil bobbins 12 according to the positions of the pins 5 of the high-voltage terminal sockets 4.

SUMMARY OF THE INVENTION

In view of the foregoing, it is an object of the present invention to provide an engine igniting coil device of the type, wherein a plurality of coil units, each consisting of a core with a primary coil and a secondary coil wound thereon, are mounted in a coil case and potted therein with melted insulating resin to form an integral coil device, and which includes the following improvements:

(1) The device has a coil cover that is fitted in the coil case and is provided at its specified positions with holes for mounting sockets of high-voltage terminals for the coil units to assure correct mounting of a high-voltage terminal of each coil unit at the specified position without tilting;

(2) The coil cover is provided at its specified places with holes in which the high-voltage terminal sockets are mounted and temporarily secured at their protrusions engaging with stepwise notches formed thereat to prevent the high-voltage terminal sockets from lifting when potting the coil units with melted resin in the coil case;

(3) The coil cover has a trapping groove at the whole periphery to prevent melted resin from leaking-out through a small gap between the cover and the case by the capillary action while the melted resin is injected into the case.

Another object of the present invention is to provide an engine igniting coil device of the type, wherein a plurality of coil units, each consisting of a core with a primary coil and a secondary coil wound thereon, are mounted in a coil case and potted therein with melted insulating resin to form an integral coil device, and which is featured by a coil cover being mountable in the coil case and having high-voltage terminal sockets and low-voltage terminal sockets for the coil units allows preliminarily performing wiring between each coil and corresponding terminal socket in free-space condition and subsequent mounting of the coil cover with coil units in the coil case.

A further object of the present invention is to provide an engine igniting coil device of the type, wherein a plurality of coil units, each consisting of a core with a primary coil and a secondary coil wound thereon, are mounted in a coil case and potted therein with melted insulating resin to form an integral coil device, and which is featured by the high-voltage terminal pins of high-voltage terminal sockets provided for the coil units being inserted into corresponding receptacles provided at secondary high-voltage terminal holders of the coil units for making electrical connections therebetween and each of the high-voltage terminal holders has a plurality of receptacles selectively used for receiving a high-voltage terminal pin of the high-voltage terminal socket to make coil units commonly usable even when a distance between coil units differs from a distance between high-voltage terminal sockets.

DESCRIPTION OF THE PREFERRED EMBODIMENTS

The preferred embodiments of the present invention will now be described in detail by way of example and with reference to the accompanying drawings.

Figure 1:
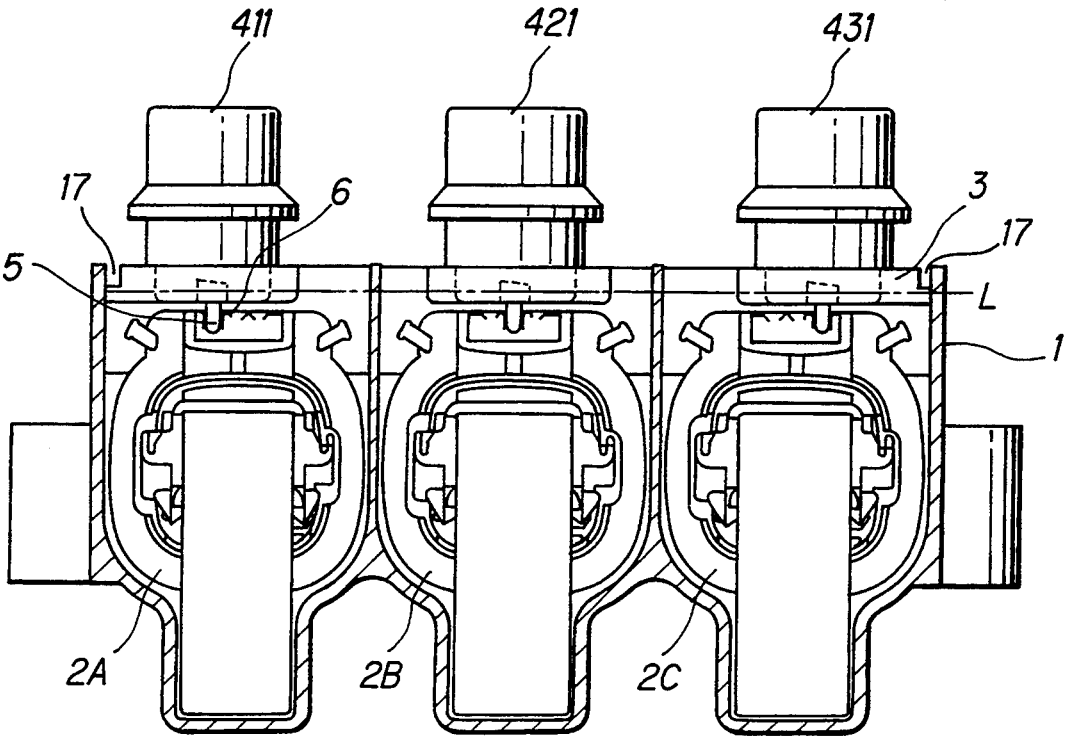
FIG. 1 is a sectional front view of an engine igniting coil device embodying the present invention.
Figure 2:
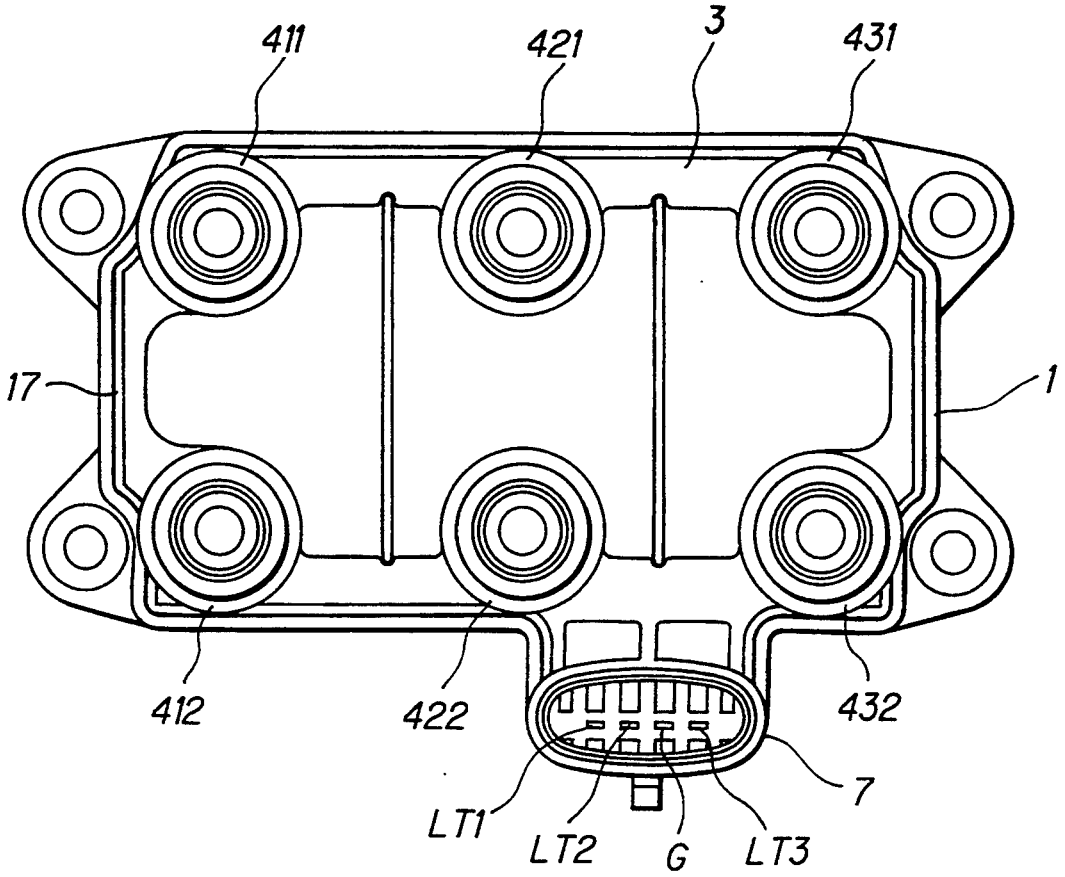
FIG. 2 is a plan view of the engine igniting coil device shown in FIG. 1.

As shown in FIGS. 1 and 2, an engine igniting coil device according to the present invention comprises three coil units 2A, 2B and 2C arranged in a coil case 1 and integrally molded therein by potting with insulating resin, and a coil cover 3 which is fitted in the coil case to hold high-voltage terminal sockets 4 (411, 412, 421, 422, 431, 432) of the coil units at specified positions thereof.

The high-voltage terminal sockets 4 are mounted at the specified positions on the coil cover and, at the same time, pins 5 protruding from the bottom of each high-voltage terminal socket 4 are inserted into the corresponding receptacles 6 provided on the coil units 2, whereby the electrical connections between the sockets 4 and the coil units 2 is completed.

Low-voltage terminal sockets 7 of the coil units 2 are integrally formed with the coil cover 3.

Figure 3:
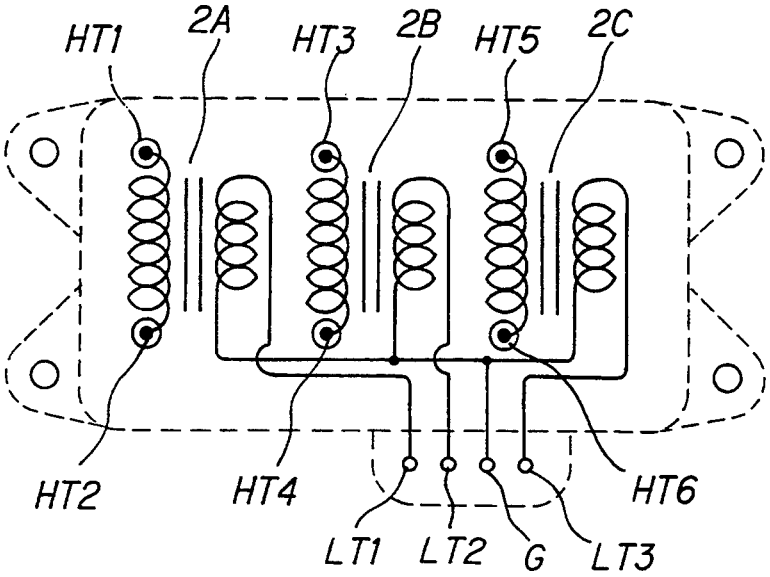
FIG. 3 is a view showing electric connections of the engine igniting coil device shown in FIG. 1.

FIG. 3 shows an electrical connection diagram of the ignition coil device, wherein characters HT1–HT6 designate secondary high-voltage terminals of the coil units 2, characters LT1–LT3 designate primary low-voltage terminals of the coil units and character G designates a ground terminal commonly used for grounding the coil units.

Figure 4:
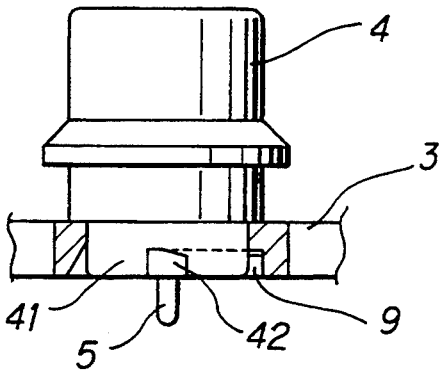
FIG. 4 is a sectional front view of a socket portion of high-voltage terminal attached to a coil cover.
Figure 5:
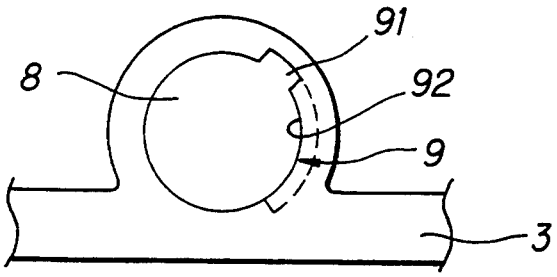
FIG. 5 is a top plan view of a receiving hole made in the coil cover for mounting the socket portion of a high-voltage terminal.
Figure 6:
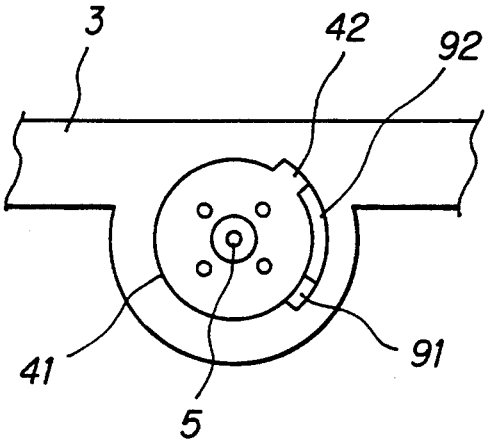
FIG. 6 is a rear view of a socket portion of high-voltage terminal to be inserted in the cover portion.

The high-voltage terminal sockets 4 are attached to the coil cover 3 in such a way that a boss or tip portion 41 of a socket of each coil unit may be inserted into a hole 8 made at the specified place of the coil cover 3 and may engage at its lug or protrusion 42 with a step 9 formed in the hole 8 for temporarily fixing the socket in the coil cover as shown in FIGS. 4 to 6.

As shown in FIGS. 5 and 6, the tip of the socket 41 is inserted into the hole in such a way that a protrusion 42 formed at the socket tip 41 passes through a notch 91 formed at the step portion 9 of the hole 8, and the socket 4 is then turned to lock the protrusion 42 at the lower side of the step 92 of the step portion.

The constructed device according to the present invention is capable of correctly positioning the high-voltage terminal sockets 4 at specified places through the coil cover 3 in relation to the respective coil unit mounted in the coil case 1.

The electrical connections between the high-voltage terminal sockets 4 and the respective coil units 2 in the coil case 1 can be easily and surely achieved only by mounting the sockets in the holes made in the coil cover 3, where a pin 8 extending from each coil socket's tip can be correctly inserted into any suitable one of receptacles 6 formed on each coil unit 2.

The high-voltage socket 4 can be temporarily locked with ease in the coil cover 3 to effectively prevent the sockets from being lifted during injection of melted resin into the coil case.

Figure 7:
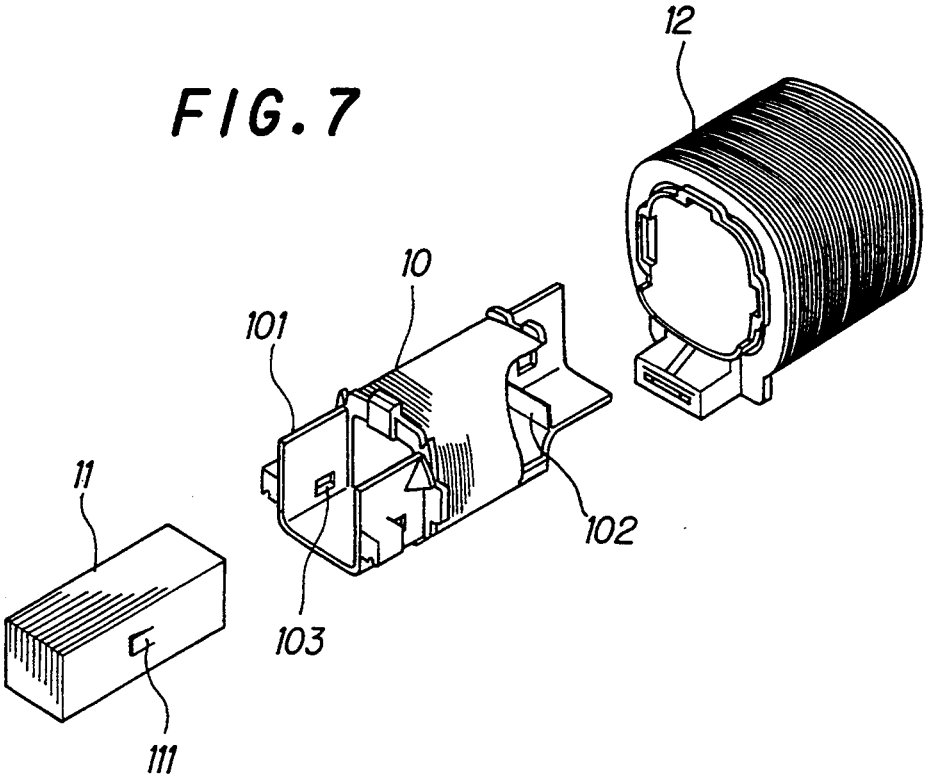
FIG. 7 is an exploded perspective view of a coil unit consisting of a primary coil bobbin, a secondary coil bobbin and an I-type core mountable in the primary coil bobbin.
Figure 8:
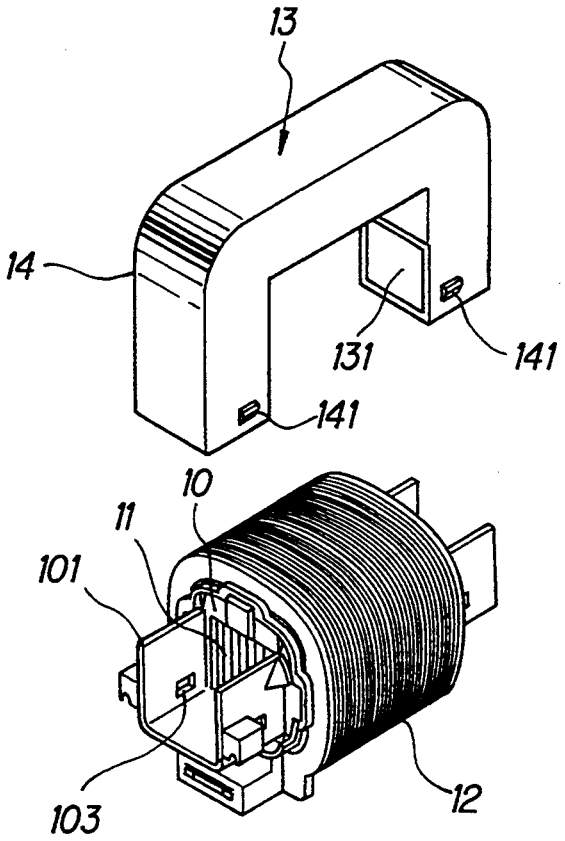
FIG. 8 is an exploded perspective view of a coil unit consisting of a primary coil bobbin, a secondary coil bobbin and an I-type core assembly having a U-type core mountable therein.

As shown in FIGS. 7 and 8, a primary coil bobbin 10 includes an I-type core 11 and has a secondary coil bobbin 12 fitted thereon. A U-type core is inserted in a core holding portion 101 integrally formed on the primary coil bobbin 10.

Figure 9:
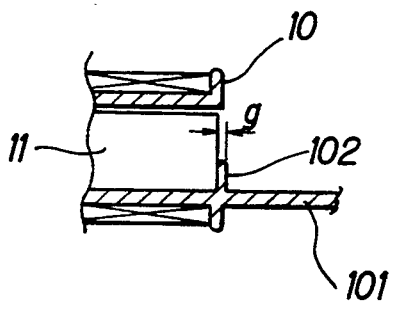
FIG. 9 is a sectional side view of a stopper portion formed on a core holding portion for positioning an I-type core insertable into a coil bobbin.
Figure 10:
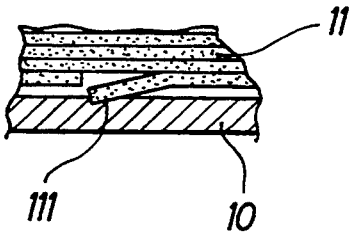
FIG. 10 is a sectional side view of spring lugs of I-type core, which are insertable into a side wall of primary side coil bobbin.

The I-type core 11 consisting of a laminated core has a spring lug 111 formed by cutting and bending up a part of an exterior sheet of the laminated core. The core holding portion 101 has a stopper portion 102 for positioning the I-type core 11 to be inserted into the primary coil bobbin 10 (see FIG. 9). The I-type core 11 is inserted into a bore (hollow portion) of the primary coil bobbin 10, with the spring lug 111 being compressed by the bobbin's inner wall, until the core at its tip abuts the stopper portion 102 and is firmly fixed in the specified position by the spring lug 111 biting the inner wall of the bobbin 10 (see FIG. 10).

Figure 11:
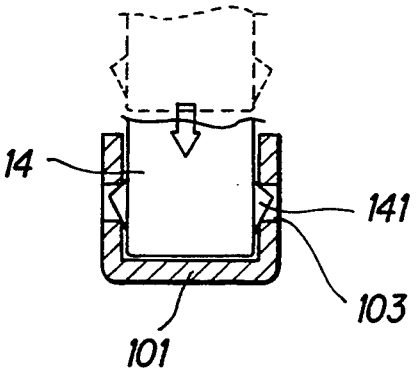
FIG. 11 is a sectional front view showing hooking portions projecting from both ends of a core cover, which is fitted in a bore formed in a coil holding portion of a coil bobbin.

The U-type core 13 is covered with a core cover 14 made of relatively flexible material, e.g., polypropylene, but being exposed at both faces, to absorb the possible thermal deformation of the core. The core cover 14 has hooks 141 protrusively formed at both end portions and it may be fixed to the core holding portion 101 by fitting the hooks 141 in the holes 103 made in the core holding portion 101 (see FIG. 11).

The U-type core 13 in the fitted state opposes with a specified gap at both faces 131, respectively, to the corresponding faces of the I-type core 11 to form a core of a closed magnetic circuit.

In this case, the stopper portion 102 serves as a spacer for keeping a specified gap "g " between a face of the I-type core 11 and an opposing face 131 of the U-type core 13.

Figure 12:
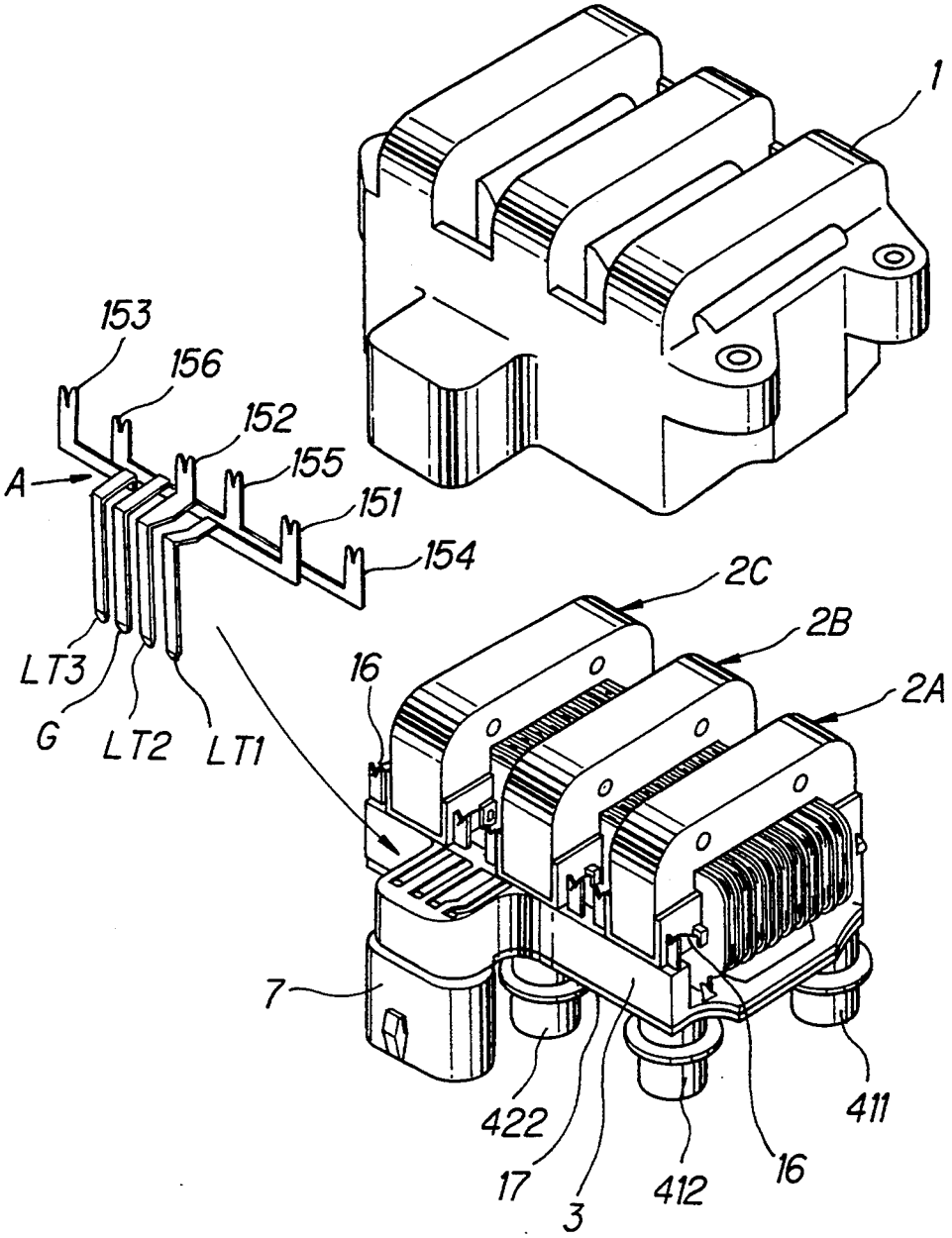
FIG. 12 is an exploded perspective view showing the assembled engine igniting coil device shown in FIG. 11.

FIG. 12 is a view for explaining how to assemble an ignition coil device according to the present invention. A coil cover 3 with high-voltage terminal sockets 4 (411, 412, 421, 422, 431 and 432) previously mounted therein is further provided with coil units 2 (2A, 2B and 2C) at the specified respective places thereof in such a way that high-voltage terminal pins 5 protruding from the tip of the high-voltage terminal sockets 4 are inserted into the respective receptacles 6 provided at the coil units 2 (see FIG. 1). Lead wires 16 from the primary coil units 2 are connected to corresponding contact ends 151–156 connected respectively to primary-side terminals LT1–LT3 and a ground terminal "G" of a low-voltage terminal socket 7 and then a coil case 1 is mounted on the assembled coil cover 3.

The contact ends 151–156 connected to the respective terminals LT1–LT3 and the ground terminal in the low-voltage terminal socket, 7 are constructed as shown in detail at "A" in FIG. 12 and they are partly embedded, with their free ends being exposed, in a groove previously formed in the coil cover 3.

The assembled ignition coil device in the condition shown in FIG. 1 is filled with melted resin through an opening in the coil cover 3 to a level L, shown by dotted line, whereby all the components are integrally formed.

Figure 13:
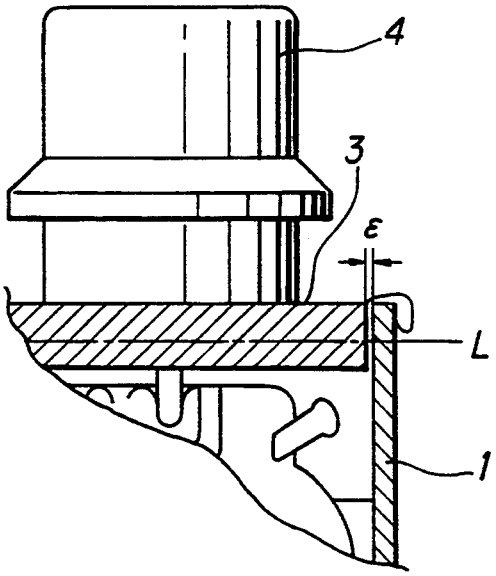
FIG. 13 (PRIOR ART)
FIG. 13 is a fragmentary front sectional view showing a gap formed between a coil case and a fitted therein coil cover.

In the case of the prior art, as shown in FIG. 13, there is left a gap "$\epsilon$" between a coil case 1 and the coil cover 3 fitted in the former, through which the melted resin in the coil case can leak out by the capillary action.

Figure 14:
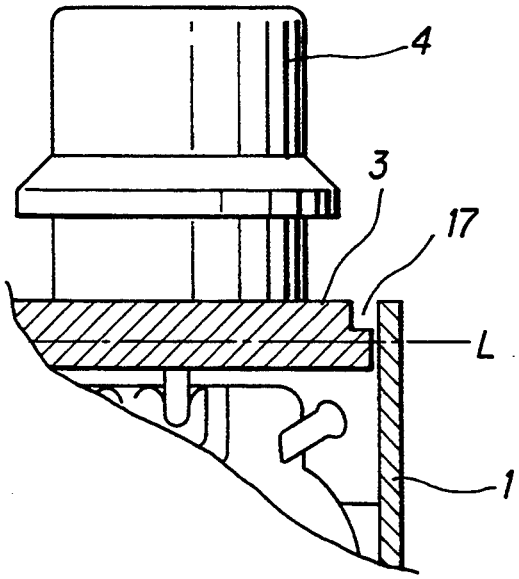
FIG. 14 is a fragmentary front sectional view showing a gap formed between a coil case and a fitted therein coil cover having a liquid trapping groove formed at the circumference thereof.

To prevent this, the ignition coil device according to the present invention is provided with a trapping groove 17 (see FIGS. 1, 2 and 14) formed around the whole periphery of the coil cover 3 not to allow the injected resin to leak out through the gap "$\epsilon$" by the capillary action.

Melted resin is injected into the ignition coil device assembled as shown in FIG. 1 through an opening in the coil cover 3 to the level L shown by dotted line to integrally pot all the components in the device.

According to the present invention, before mounting the coil units 2 in the coil case 1 it is possible to complete connections of leading wires from the coil units 2 mounted on the coil cover 3 to the high-voltage terminal pins 5 of the high-voltage terminal sockets 4 and to contact ends 151–156 of the low-voltage terminal socket provided on the coil cover 3. This makes it easier to connect, especially by soldering, lead wires 16 from the primary windings of the coil units 2 to the corresponding contact ends 151–156 of the low-voltage terminal socket 7 since free space is assured for manipulating a soldering iron.

Since the coil case 1 may be mounted on the coil cover 3 whereon the coil units are previously connected with the corresponding terminal pins of the high-voltage terminal sockets and with contact ends 151–156 of the low-voltage terminal socket 7, no space for wiring operation is required between the coil units 2 and the coil case. The size of the coil case 1 can be accordingly reduced.

Figure 15:
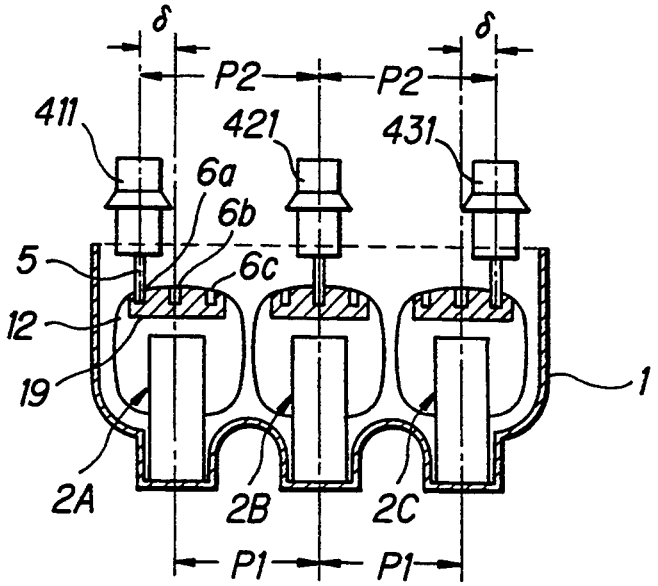
FIG. 15 is a schematic front sectional view of high-voltage terminal pins connected to corresponding coil units shown in FIG. 1.
Figure 16:
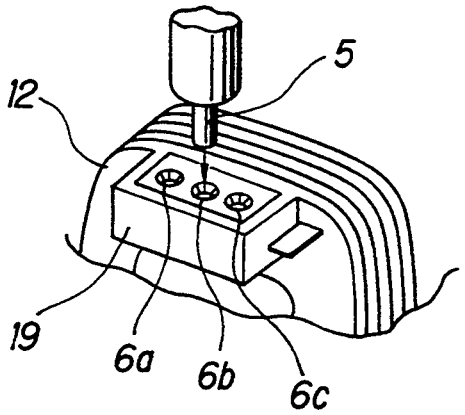
FIG. 16 is a perspective view of a high-voltage terminal holder formed integrally with a flange portion of a secondary coil bobbin.

The present invention provides the possibility of selecting an axial distance P2 between adjacent high-voltage terminal sockets 4 to be larger than an axial distance P1 between the corresponding coil units 2 in the coil case as shown in FIGS. 15 and 16. This is achieved by the fact that three parallel receptacles **6*a*, 6*b* and 6*c* are provided in a high-voltage terminal holder 19 integrally formed in a flange portion of the secondary coil bobbin 12 of each coil unit 2 and they are selectable in accordance with a pin 5, to be inserted therein, of the corresponding high-voltage terminal socket 4**.

In the shown embodiment, the pin 5 of the left high-voltage terminal 411 (412) is inserted into the receptacle **6*a* of the high-voltage terminal holder 19 and said high-voltage terminal socket 411 (412) is shifted to the left by a distance "$\delta$" from the axis of the coil unit 2A. The pin 5 of the center high-voltage terminal socket 421 (422) is inserted into the receptacle 6*b* made in the corresponding high-voltage holder 19 and said high-voltage terminal socket 421 (422) is set at the center position of the coil unit 2B. Then, the pin 5 of the right high-voltage terminal 431 (432) is inserted into the receptacle 6*c* of the high-voltage terminal holder 19 and said high-voltage terminal socket 431 (432**) is shifted to the right by a distance "$\delta$" from the axis of the coil unit 2C.

Accordingly, the present invention eliminates the necessity of preparing the variety of high-voltage terminal holders for left, center and right coil units 2 even in the case where an axial distance P1 between the coil units 2 in the coil case 1 differs from an axial distance P2 between the high-voltage terminal sockets 4. In the other words, the coil units 2 of the same construction are commonly used in spite of their positions in the coil case.

This makes it possible to effectively save the number of parts to be prepared as well as to easily assemble the coil ignition device.

Figure 17:
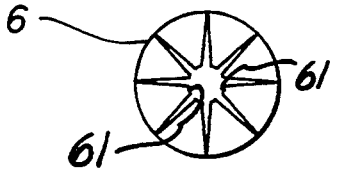
FIG. 17 is a top plan view of a receptacle for inserting a high-voltage terminal pin.
Figure 18:
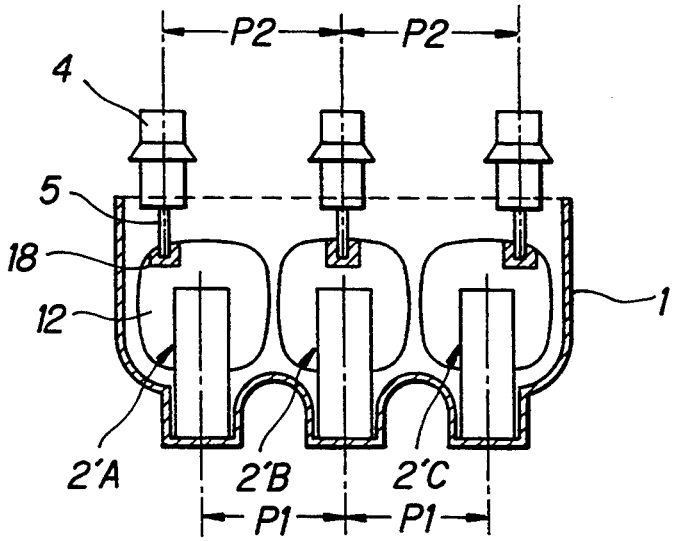
FIG. 18 (PRIOR ART)
FIG. 18 is a schematic sectional front view of high-voltage terminal pins connected to corresponding coil units in a prior art case.

Each high-voltage terminal holder has the receptacles 6 (**6*a*, 6*b*, 6*c*) which, as shown in FIGS. 16 and 17, are composed of contacts 61 radially arranged to form a conical expandable hole having an outer diameter larger than that of a high-voltage terminal pin 5** to be press-inserted therein.

Therefore, the receptacle 6 can achieve reliable electric connection of their contact pieces with the high-voltage terminal pin 5 by absorbing a possible relative displacement of the high-voltage terminal pin 5 to be inserted therein.

As described above, the present invention provides an engine ignition coil which involves the following improvements:

A coil cover has holes through which high-voltage terminal sockets are correctly disposed at specified positions in relation to corresponding coil units 2 mounted in a coil case, eliminating the possible error in positioning and mounting the high-voltage terminal sockets for the coil units.

The coil cover can temporarily lock with ease the high-voltage terminal sockets therein to prevent the high-voltage terminal sockets from moving up when potting the coil units with melted resin in the coil case.

The coil cover has a grooved trap at the whole periphery to prevent resin from leaking-out through a small gap between the cover and the case by the capillary action during injection of the melted resin into the case.

The coil cover that fits in the coil case and has high-voltage terminal sockets and low-voltage terminal sockets for the coil units allows easily wiring between each coil unit and corresponding terminal socket in free-space condition and subsequent mounting of the cover with coil units in the coil case. No space for wiring operation is required between the coil units 2 and the coil case. Accordingly, the size of the coil case 1 can be reduced with no dead space therein.

The high-voltage terminal pins of high-voltage terminal sockets provided for the coil units are inserted into corresponding receptacles provided at secondary-side high-voltage terminal holders of the coil units for making electrical connections therebetween and each of the high-voltage terminal holders has a plurality of receptacles selectively used for receiving a high-voltage terminal pin of the high-voltage terminal socket to make coil units commonly usable even when a distance between coil units differs from a distance between high-voltage terminal sockets.

What is claimed is:

1. An engine igniting coil device comprising:

a plurality of coil units, each coil unit consisting of a core with a primary coil and a secondary coil provided on said core, a coil case wherein said coil units are integrally potted with insulating resin, a coil cover fitable in the coil case, and a high-voltage terminal socket connected to each said coil unit, characterized in that the coil cover has a plurality of holes made at predetermined locations corresponding to respective said coil units in said coil case for mounting the high-voltage terminal sockets in said holes and each of said holes has a stepped notch with which a lug on the high-voltage terminal socket is engaged to temporarily lock the high-voltage terminal socket to the coil cover.

2. An engine igniting coil device as claimed in claim 1, characterized in that the coil cover insertably mountable in the coil case has a trap formed at a whole periphery of said coil cover for preventing the insulating resin from leaking from the coil case through a gap between the case and the cover by capillary action when the insulating resin is injected into the case in a melted condition.

3. An engine igniting coil device comprising:

a plurality of coil units, each coil unit consisting of a core with a primary coil and a secondary coil provided thereon, a coil case wherein said coil units are integrally potted with insulating resin, a coil cover fitable in the coil case, a plurality of sockets of high-voltage terminals mounted in said coil cover, and a plurality of low-voltage terminals for the coil units mounted in said coil cover, the coil units being disposed at predetermined locations on the coil cover for connecting each coil unit to a said high-voltage terminal socket and a said low-voltage terminal the coil case being positioned over the coil units mounted in the coil cover after said connecting of the coil units to said high-voltage and low-voltage terminals and before said potting with insulating resin.

4. An engine igniting coil device as claimed in claim 3, characterized in that with each coil unit mounted at said predetermined location on the coil cover, a pin of a said high-voltage terminal socket for said coil unit is inserted into a receptacle provided on the coil unit for making electrical connection therebetween.

5. An engine igniting coil device as claimed in claim 4, characterized in that a secondary high-voltage terminal holder of each coil unit has plural receptacles which are selectably used for receiving said pin of said high-voltage terminal socket for said coil unit to make electrical connection therebetween.

6. An engine igniting coil device as claimed in claim 5, characterized in that each receptacle has a plurality of contacts radially arranged to form a conical female contact hole for receiving said high-voltage terminal pin.

* * * * *